US008794244B2

(12) United States Patent
Hammel et al.

(10) Patent No.: US 8,794,244 B2
(45) Date of Patent: Aug. 5, 2014

(54) ELECTRONIC RECHARGEABLE SMOKING UNIT

(75) Inventors: Jeff Hammel, York, PA (US); Martin Weiss, York, PA (US)

(73) Assignee: The Meeting Room LLC, York, PA (US)

( * ) Notice: Subject to any disclaimer, the term of this patent is extended or adjusted under 35 U.S.C. 154(b) by 774 days.

(21) Appl. No.: 12/927,669

(22) Filed: Dec. 27, 2010

(65) Prior Publication Data

US 2012/0160251 A1 Jun. 28, 2012

(51) Int. Cl.
*A24F 47/00* (2006.01)
*A24F 1/28* (2006.01)

(52) U.S. Cl.
CPC ..... *A24F 1/28* (2013.01); *A24F 47/008* (2013.01); *A24F 47/004* (2013.01)
USPC ..... 131/191

(58) Field of Classification Search
CPC ..... A24F 47/008
See application file for complete search history.

(56) References Cited

U.S. PATENT DOCUMENTS 4,066,088 A * 1/1978 Ensor ..... 131/185
6,349,728 B1 * 2/2002 Pham ..... 131/185

OTHER PUBLICATIONS

WO 2007/098337 Aug. 2007 Brenneise, Jake A24F 1/30.*

* cited by examiner

*Primary Examiner* — Michael J Felton

(57) ABSTRACT

Electronic Rechargeable Smoking Unit is a fully self-contained device for smoking tobacco. The Unit uses an electrically heated element in addition to oxygen that is induced by inhalation on the Unit to combust the tobacco that is placed within the chamber. No oxygen can be induced without the user inhaling through the mouthpiece. Therefore, the tobacco only burns whilest the user is inhaling resulting in all the smoke from the tobacco passing through the lungs of the user. There is a replaceable/reusable filter placed between the burn chamber and the mouthpiece. The Unit also comes with a hose that can be attached to the mouthpiece as an extension tube. The mouthpiece of the hose contains a switch to control the circuit.

2 Claims, 5 Drawing Sheets

ELECTRONIC RECHARGEABLE SMOKING UNIT

The present invention relates to an electronic cigarette.

SUMMARY OF THE INVENTION

An electronic cigarette described and claimed in this patent application is a new invention that will reduce the amount of tobacco needed for a consumer to gain the full benefits of a cigarette. It will also reduce second hand smoke as well as the environmental impact on the tobacco grower.

This invention adopts a brand new technical solution to create a device that does not resembles a conventional cigarette and the cigarette smoking process. The electronic cigarette is designed so that the user can smoke regular tobacco in all weather conditions. Its fully enclosed weather protected casing is designed so that the smoker can smoke in rain, wind, and in extreme conditions. The cylindrical attachment is an additional piece that comprises of a 90 cm long plastic tube with electrical wire running inside of it with 2 reed switches on the mouthpiece. The plastic tube is simply placed over the mouthpiece of the stand alone unit and therefore becomes part of 1 unit device. With the additional plastic tubing attached the user can smoke hands free. All that is required is for the user to bite down on the mouthpiece and the 2 reed switches will separate and thus close the circuit and turn on the device.

BRIEF DESCRIPTION OF THE DRAWINGS

FIG. 1 The power source of this unit is 4 AA NiMH batteries FIG. 1 (1) that can be recharged via the charging port (4). When the system is activated by the trigger switch (3) the power from the batteries will be supplied through the P-Channel MOSFET (12), 5 micro-henry Inductor (13) and connector (10) to the heating element load (11). The MOSFET (12) is controlled by a step down voltage regulator controller chip (7), in this design a TI TPS64202. The remaining components are required for proper function of the voltage regulator design. 10 micro-farad Capacitors (5) and 47 microfarad capacitor (18) provide filtering. 100,000 ohm Resistor (6) is used to shut off the regulator, and when it is shorted by switch (3) the system is activated. Parallel 100 k ohm resistor (8) and 0.033 ohm resistor (9) are used by controller chip (7) to measure the current in the nickel chrome wire heater (11). Silicon RF Schoottky Diode for Mixer Applications in the VHF/UHF range (20). 4.7 microfarad Capacitor (14) filters feedback voltage from resistor divider formed by the series connection of 150,000 ohm resistors (15) and (17). 680,000 ohm Potentiometer (16) allows for adjustment of the output voltage. Voltage controller (7) uses this voltage to control output voltage applied to heater (11). Led (19) and its associated 270 ohm resistor (21) provide visible indication that the heater (11) is active. Zero ohm Resistor (2) is used for debugging purposes and is not relevant to the function of the design.

Specifications of the Device.

Figure 1:
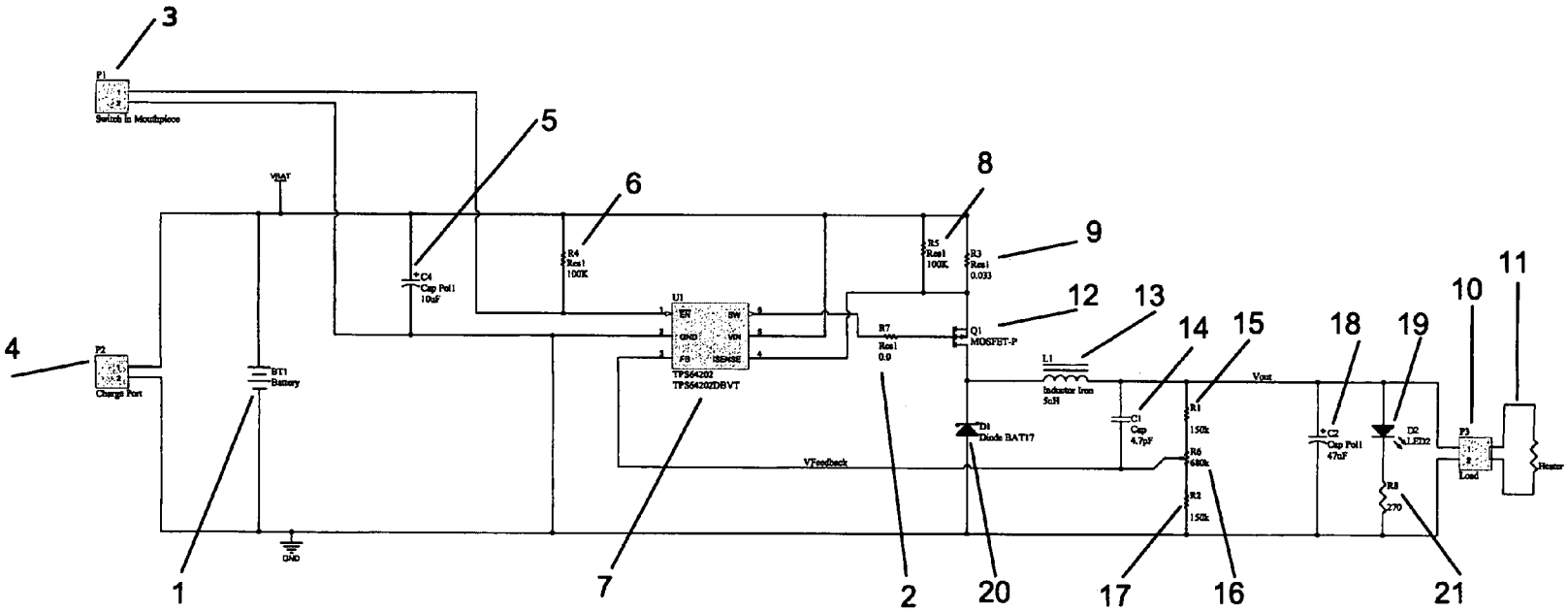
FIG. 1 illustrates the schematics of the circuit board for the electronic rechargeable smoking device.
Figure 2:
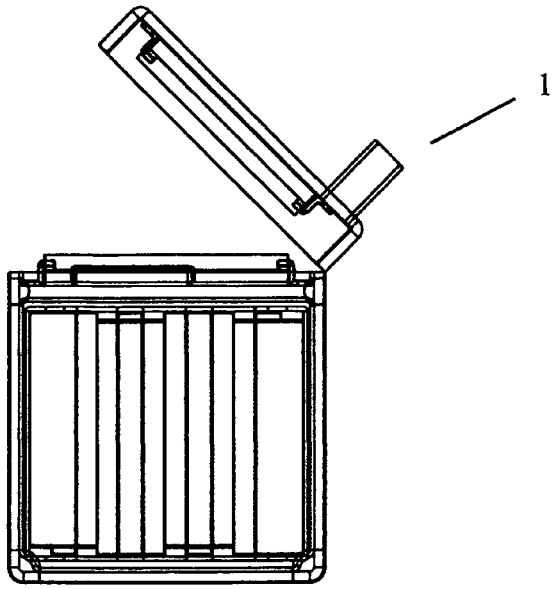
FIG. 2 illustrates a side view of the exterior of the electronic rechargeable smoking device with the top part of the invention open showing mouthpiece.

The complete device FIG. 2 measures 2.6 cm wide 8.0 cm in height and 6.5 cm in length.

Figure 3:
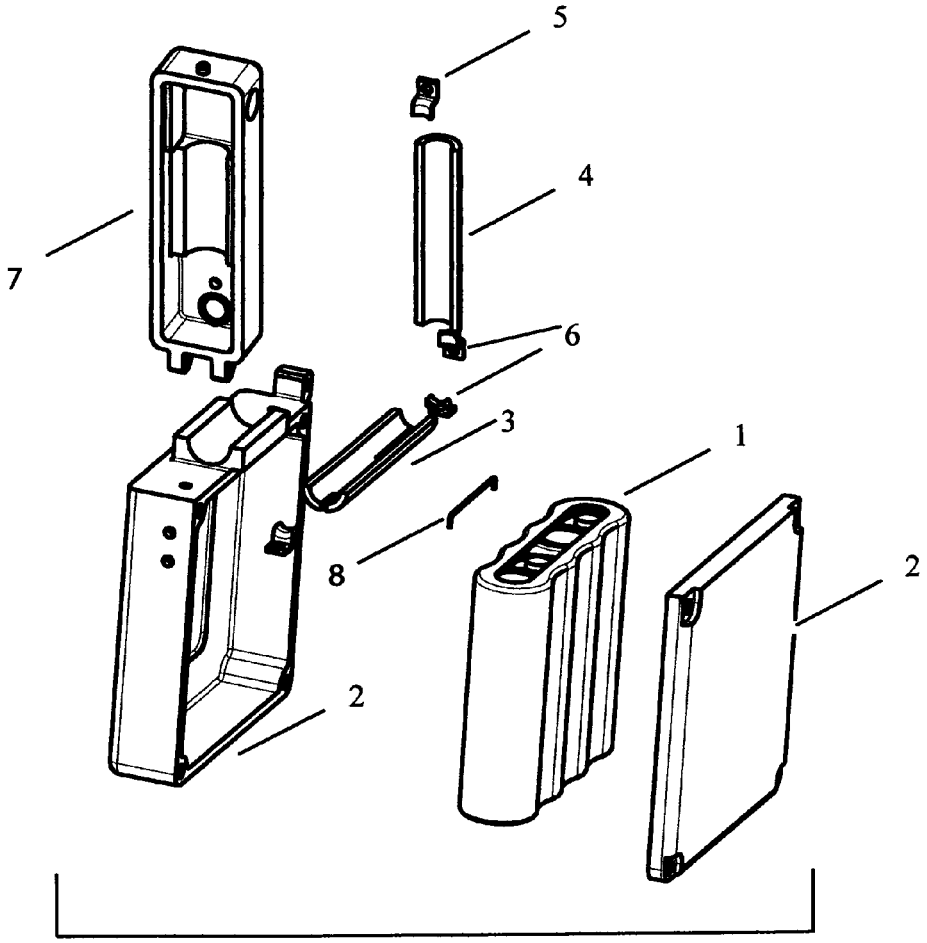
FIG. 3 Illustrated and exploded view of the electronic rechargeable smoking device showing batteries (1), exterior casing (2), porcelain tubes (3) and (4), clamps (5) and (6), lid (7) and wire (8).

The battery unit FIG. 3 (1) measure 1.5 cm in width 5.0 cm in height and 5.5 cm in length.

The case body FIG. 3 (2) is 2.5 mm in width.

The porcelain FIG. 3 (3) and FIG. 3 (4) is 4.5 cm long 1.0 cm wide and 0.5 cm deep.

The claps FIG. 3 (5) and FIG. 3 (6) are small clamps to hold the top porcelain half cylinder tube in place.

FIG. 3 (8) is the heating element.

The mouthpiece FIG. 2 (1) is cylindrical 1.5 cm in height and 0.5 cm wide in its opening.

The top cover FIG. 3. (7) is 7.0 cm in length whereby the hinge is 0.5 cm long 2.5 cm wide and 1.1 cm in height. It holds FIG. 3. (5) and FIG. 3 (6) and FIG. 3 (4).

Figure 4:
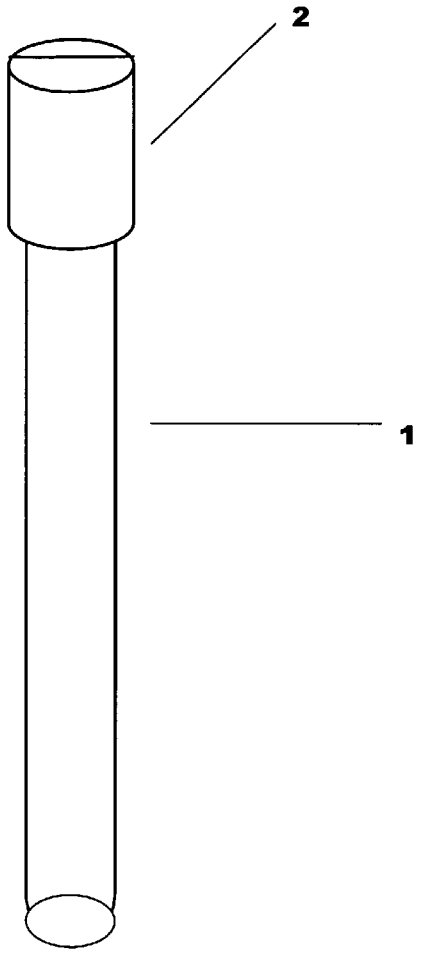
FIG. 4 illustrates a view of cylindrical smoking tube that connects to the electronic rechargeable smoking device on one end and a mouthpiece on the other.

The cylindrical tube FIG. 4 (1) measures 90 cm long plastic tube with electrical wire running inside of it with 2 reed switches FIG. 4 (2) on the mouth piece.

The circuit board power is made up of a 2 layer board.

TABLE OF COMPONENTS

Figure 5:
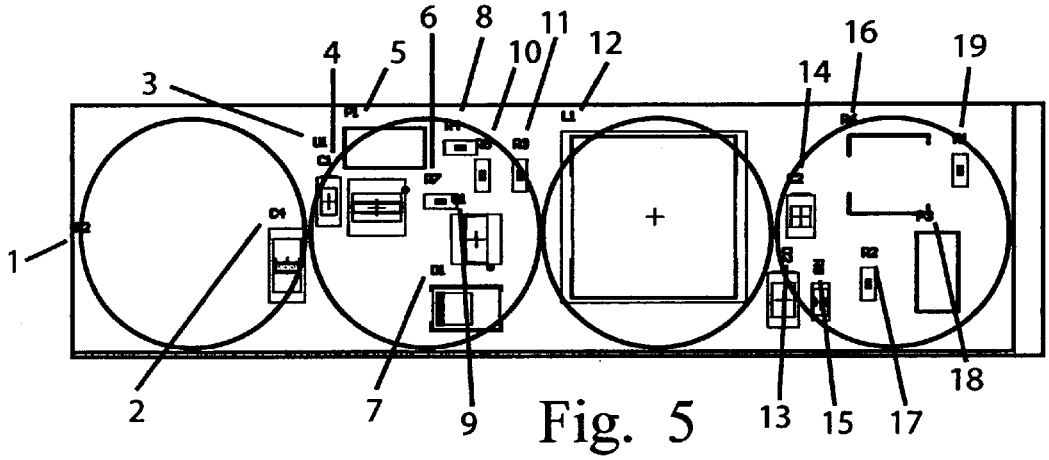
FIG. 5 illustrates a magnified end-on sectional view showing batteries, circuit board and body of the electronic rechargeable smoking device.

| FIG. 5 Number | Designator | Footprint | Description |
|---|---|---|---|
| 4 | C1 | CAPC1608N | Capacitor |
| 14 | C2 | CAPC1210N | Polarized Capacitor (Radial) |
| 2 | C4 | CAPC3216N | Polarized Capacitor (Radial) |
| 7 | D1 | DIOM 2019 11N | Silicon RF Schoottky Diode for Mixer Applications in the VHF/UHF range |
| 13 | D2 | CAPC2012N | Typical RED, GREEN, YELLOW, AMBER GaAs LED |
| 12 | L1 | WE-TPC 1038, LH | Magnetic Core Inductor |
| 5 | P1 | HDR1 2 | Header, 2-Pin |
| 1 | P2 | Powerjack | Header, 2-Pin |
| 18 | P3 | HDR1 2 | Header, 2-Pin |
| 9 | Q1 | SOT23-3L | Transistor, Mosfet P Channel |
| 19 | R1 | RESC0603N | Resistor |
| 17 | R2 | RESC0603N | Resistor |
| 11 | R3 | RESC0603N | Resistor |
| 8 | R4 | RESC0603N | Resistor |
| 10 | R5 | RESC0603N | Resistor |
| 16 | R6 | POT4MM-2 | Square Trimming Potentiometer |
| 6 | R7 | RESC0603N | Resistor |
| 15 | R8 | RESC1608L | Resistor |
| 3 | U1 | SOT26A-6AN | IC, Step Down Cont |

The invention claimed is:

1. A smoking device for smokers of tobacco, comprising:

a porcelain tube configured to hold tobacco, clamps for holding the top of the porcelain tube in place, a nickel chromium heating element, a power source, wherein the power source is a battery unit, a circuit board that controls the power source and heating element a switch adapted to close or open a circuit in response to inhalation and expiration, wherein the porcelain tube, circuit, switch, and heating element are configured such that the when the user draws air through the device, the switch closes a circuit causing the circuit board to provide electric current from the power source to the heating element to burn the tobacco in the porcelain tube.

2. The smoking device of claim 1, wherein the battery unit comprises rechargeable batteries.

* * * * *